United States Patent [19]

Miyawaki

[11] Patent Number: 4,804,998

[45] Date of Patent: Feb. 14, 1989

[54] SHEET TRANSPORT CONTROL METHOD FOR COPIER AND OTHERS

[75] Inventor: Shozo Miyawaki, Urawa, Japan

[73] Assignee: Ricoh Company, Ltd., Tokyo, Japan

[21] Appl. No.: 102,854

[22] Filed: Sep. 30, 1987

[30] Foreign Application Priority Data

Oct. 3, 1986 [JP] Japan ..... 61-234545

[51] Int. Cl.[4] ..... G03G 15/00

[52] U.S. Cl. ..... 355/14 SH; 271/258; 355/3 SH

[58] Field of Search ..... 355/3 SH, 14 SH, 14 R; 271/258, 259

[56] References Cited

U.S. PATENT DOCUMENTS

| | | | |
|---|---|---|---|
| 4,084,900 | 4/1978 | Yamaoka et al. | 355/14 SH |
| 4,310,153 | 1/1982 | Kikuchi | 271/259 |
| 4,502,777 | 3/1985 | Okamoto et al. | 355/14 R |
| 4,551,813 | 11/1985 | Sanbayashi et al. | 271/258 X |
| 4,589,080 | 5/1986 | Abbott et al. | 355/14 R X |
| 4,589,763 | 5/1986 | Fujiwara | 355/14 R |

*Primary Examiner*—A. C. Prescott
*Assistant Examiner*—Jane Lau
*Attorney, Agent, or Firm*—Oblon, Fisher, Spivak, McClelland & Maier

[57] ABSTRACT

A sheet transport control method for deciding whether or not the transport of a sheet in a copier and other is normal. Sheet feed sensors, a registration sensor, a separation sensor, a fixation sensor, a discharge sensor and others each being responsive to the ends of a sheet are provided. The actual timing of passage of a sheet sensed by one of the sensors is compared with a reference timing, and the resulting increment or decrement in timing is fed back to the reference timings which are respectively, assigned to each of the other sensors that are located downstream of that one sensor. This prevents the deviation in timing from being sequentially accumulated from the upstream sensor to the downstream sensor. When the sum of the increments and decrements exceeds a predetermined value, an alarm is produced for alerting a person to such an occurrence.

4 Claims, 6 Drawing Sheets

FIG. 3

| SENSOR \ TIMING (PULSES) | ARRIVAL | DEPARTURE |
|---|---|---|
| SHEET FEED SENSOR | 10 ~ 16 | 40 ~ 46 |
| REGIST SENSOR | 55 ~ 61 | 85 ~ 91 |
| SEPARATE SENSOR | 100 ~ 106 | 130 ~ 136 |
| FIX SENSOR | 150 ~ 156 | 180 ~ 186 |
| DISCHARGE SENSOR | 186 ~ 192 | 216 ~ 222 |

FIG. 4

| SENSOR \ TIMING (PULSES) | ARRIVAL | DEPARTURE |
|---|---|---|
| SHEET FEED SENSOR | 10 ~ 16 | 40 ~ 46 |
| REGIST SENSOR | 56 ~ 62 | 86 ~ 92 |
| SEPARATE SENSOR | 101 ~ 107 | 131 ~ 137 |
| FIX SENSOR | 151 ~ 157 | 181 ~ 187 |
| DISCHARGE SENSOR | 187 ~ 193 | 217 ~ 223 |

| FIG. 6A |
| --- |
| FIG. 6B |

SHEET TRANSPORT CONTROL METHOD FOR COPIER AND OTHERS

FIELD OF THE INVENTION

Background of the Invention

The present invention relates to a sheet transport control method which determines whether or not the transport of a sheet is normal by comparing with a reference timing an actual timing of a passage of a sheet end, which is sensed by a sheet end sensor disposed on a sheet transport path. The sheet transport control method to which the present invention pertains is applicable to a copier, a printer and others.

Discussion of the Background

In a copier, for example, sheets stacked in a sheet cassette are fed one by one to be transported through a predetermined transport path. After an image has been transferred to the sheet, the sheet is driven out of the copier to reach a discharge tray or the like. Arranged along the transport path are sheet feed sensors, a registration sensor, a separation sensor, a fixation sensor, a discharge sensor and other sensors each being responsive to the ends of a sheet. Based on the outputs of such sensors, sheet jams at any positions between a sheet cassette selected and, for example, the discharge tray are detected. Generally, sheet jams are ascribable typically to any of the following occurrences:

(i) an abnormality in drive sources which are associated with sheet transport;

(ii) a failure of sheet transport due to external factors;

(iii) a variation of characteristic values due to contamination, deterioration and others of the sensors; and (iv) a failure of the sensors themselves.

A prior art sheet transport control method is apt to cause sheet jams since it determines whether or not the sheet transport is normal simply by comparing with a predetermined reference timing an actual timing of passage of sheet end, which has been sensed by any sheet end sensor, and then seeing if they are coincident. Specifically, because the deviations of timings sensed by the individual sensors are sequentially accumulated, any of the sensors located on the downstream side involves all of the deviations of timing which occurred on the transport path upstream of that sensor.

SUMMARY OF THE INVENTION

It is, therefore, an object of the present invention to provide a sheet transport control method for a copier and others which eliminates sheet jams which are ascribable to various factors other than the abnormality in drive sources, the failure of sensors and other fatal factors.

It is another object of the present invention to provide a generally improved sheet transport control method for a copier and others.

A sheet transport control method for an image-forming device which decides whether or not transport of a sheet is normal by comparing with a predetermined reference timing an actual timing of movement of a sheet end past each of a plurality of sensors of the present invention comprises the steps of (a) constantly storing in a memory a plurality of latest timings sensed by any of the sensors, (b) averaging the latest timings sensed, (c) comparing an average timing produced by the step (b) with a reference timing, and (d) if the average timing has an increment or a decrement relative to the reference timing, feeding back the increment or the decrement to reference timings which are assigned one to each of the other sensors located downstream of that sensor.

The above and other objects, features and advantages of the present invention will become more apparent from the following detailed description taken with the accompanying drawings.

BRIEF DESCRIPTION OF THE DRAWINGS

FIG. 3 is a table showing the adequate ranges of sheet timings as sensed by individual sensors;

FIG. 4 is a table similar to that of FIG. 3, showing specific values of timing data which are modified in response to a deviation in the average value of any upstream detection timing;

DESCRIPTION OF THE PREFERRED EMBODIMENT

Figure 1:
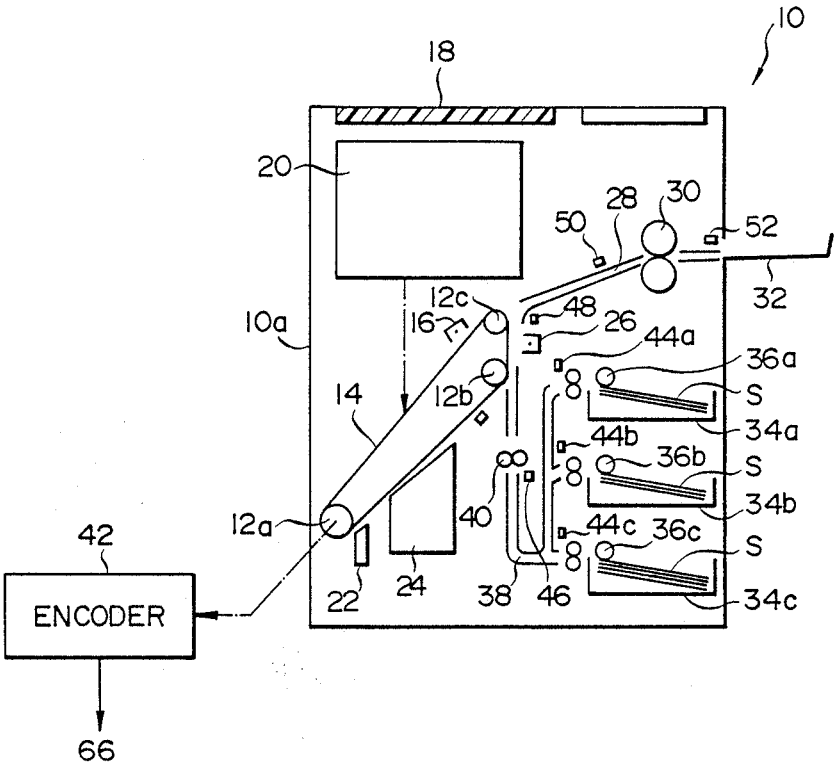
FIG. 1 is a schematic view of a copier to which the present invention is applicable.

Referring to FIG. 1 of the drawings, a copier to which the present invention is applicable is shown and generally designated by the reference numeral 10. The copier 10 includes a housing 10*a* in which a photoconductive element 14 in a form of belt is accommodated. The belt 14 is rotatable supported by a plurality of rollers 12*a*, 12*b* and 12*c*. A charger 16 is located to face the belt 14 for uniformly charging the surface of the latter to a predetermined polarity. An optical system 20 serves to scan a document which is laid on a glass platen 18, while exposing the belt 14 imagewise with the light which is reflected by the document. An eraser 22 for erasing a needless electrostatic latent image, a developing unit 24 for developing an electrotatic latent image, and a transfer charger 26 for transferring the developed image to a sheet S are sequentially arranged downstream of the charger 16 and optical system 20 with respect to an intended direction of rotation of the belt 14. The sheet S carrying the developed image therewith is fed through a transport path 28 to a fixing roller 30 to be fixed thereby and, then, driven out of the copier 10 to a discharge tray 32. A plurality of sheet cassettes 34*a*, 34*b* and 34*c* each being loaded with sheets of a different size are detachably mounted in the copier housing 10*a*. The sheets in the sheet cassettes 34*a*, 34*b* and 34*c* are selectively fed by individual feed rollers 36*a*, 36*b* and 36*c* and, then, transported at a predetermined timing to a transfer station where the transfer charger 26 is located by a common transport path 38 and a registration roller 40. It is to be noted that an encoder 42 is directly connected to the roller 12*a* to generate clock pulses timed to the movement of the roller 12*a* and, therefore, to that of the belt 14.

Sheet feed sensors 44*a*, 44*b* and 44*c*, a registration sensor 46, a separation sensor 48, a fixation sensor 50 and a discharge sensor 52 are sequentially arranged along the common transport paths 38 and 28 and adjacent to, respectively, the sheet cassettes 34*a*, 34*b* and 34*c*, registration roller 40, transfer charger 26, fixing roller 30, and discharge tray 32. These sensors execute jam detection on a sheet which is fed from any one of the sheet cassettes 34*a* to 34*c* to the discharge tray 32.

Figure 2:
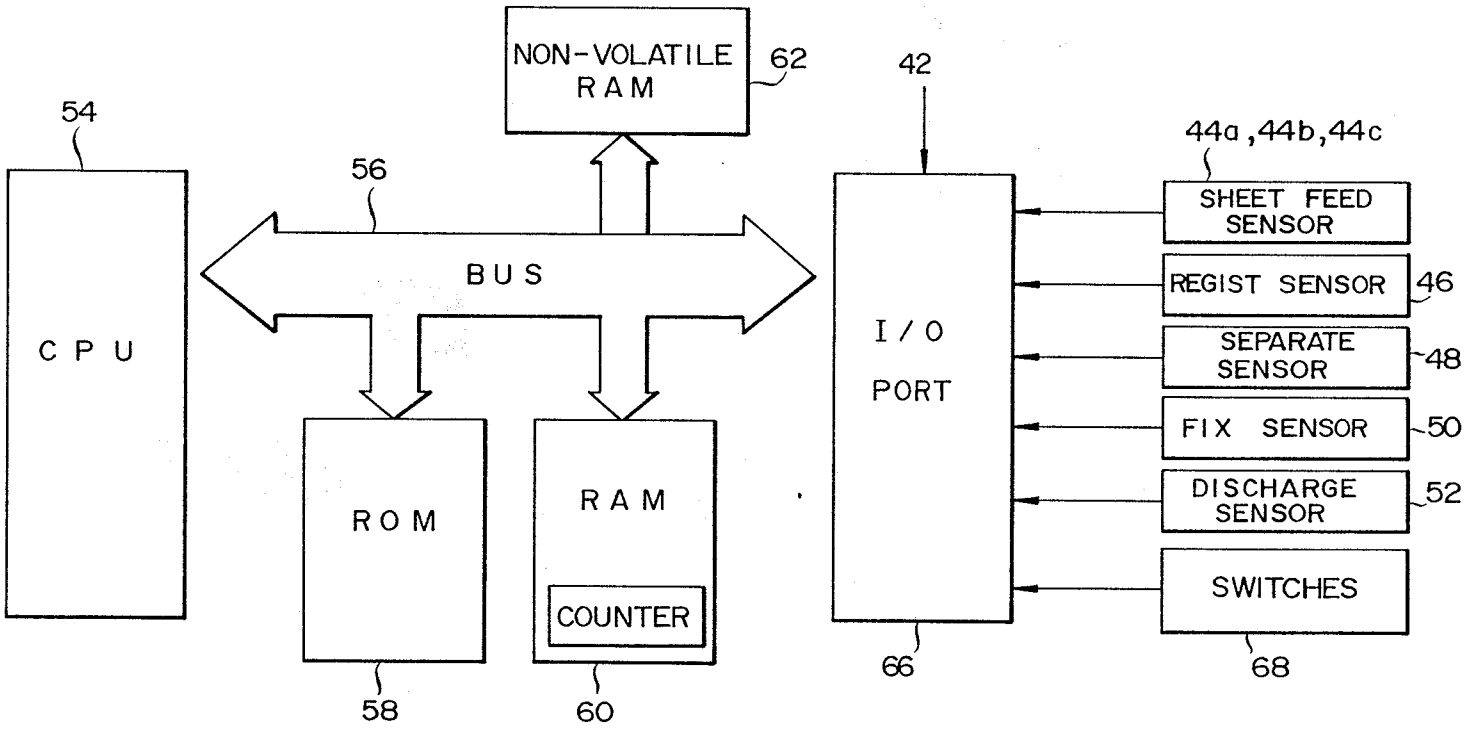
FIG. 2 is a schematic block diagram showing a control system which is installed in the copier of FIG. 1.

FIG. 2 schematically shows a control system which is installed in the copier 10. As shown, the control system includes a central processing unit (CPU) 54 which is implemented with a microcomputer, an address, data and control bus 56 extending from the CPU 54, and a read-only memory (ROM) 58, a random access memory (RAM) 60, a non-volatile RAM 62, and an input/output (I/O) port 66 which are individually connected to the CPU 54 by the bus 56. The previously mentioned various sensors, a group of control switches 68, and others are connected to the I/O port 66.

Generally, the principle of jam detection is as follows. A counter, not shown, is built in the RAM 60 of FIG. 2 for counting clock pulses which are generated by the encoder 42 as stated earlier. The timing at which a sheet S is fed from any of the cassettes 34*a* to 34*c* is selected to be the timing for starting the counter, and the content of the counter is checked when each end of the sheet S sequentially moves past the sensors 44*a*, 44*b*, 44*c*, 46, 48, 50 and 51.

Referring to FIG. 3, the adequate ranges of logical values which are representative of detection timings at the individual sensor positions are shown. As stated above, the counter starts counting timed to the feed of a sheet S from a desired one of the cassettes 34*a* to 34*c*, and the arrival and departure of the sheet S from each of the sensors 44*a*, 44*b*, 4*c*, 46, 48, 50 and 52 are checked. So long as the timing of arrival and that of departure from any of the sensors lies in their predetermined ranges as shown in FIG. 3, the transport is decided normal. Once they are brought out of the predetermined ranges, jam processing is executed deciding that the sheet S has jammed.

As outlined above, it has been customary to decide whether or not the transport is normal simply by comparing with a predetermined reference timing an actual timing of passage of a sheet S as sensed by any of the sheet end sensors. This brings about a problem that because the deviations in timing sensed by the individual sensors are sequentially accumulated, the sensor on the downstream side involves all of the deviations which occurred on the transport path upstream thereof, resulting in the likelihood of sheet jamming.

The principle of the present invention will be described hereinafter.

For the convenience of description, description will be made with respect to the registration sensor 46 only. As shown in the Table shown in FIG. 3, the sheet end detection timings at the sensor 46 should be such that the arrival timing lies in the range of 55 to 61, 58 being the center value, in terms of the number of pulses, and the departure timing lies in the range of 85 to 91, 88 being the center value. Checking the counter every time a sheet end moves past the sensor 46, the CPU 54 constantly produces an average of a plurality of latest counts. Assuming that the normal transport has failed due to a certain external factor such as an increase in the slip rate of the transport path 38, then the arrival and departure timings of a sheet S from the sensor 46 are brought out of their predetermined ranges. In the light of this, in accordance with the present invention, the average value stated above is modified according to the deviations in the arrival and departure timings. This is true with any other sensor as well.

It is important to note that although the deviation of timing with respect to each of the sensors may be negligible, it sequentially combined with the others causes a sheet jam. In FIG. 1, for example, the jam detection by the discharge sensor 52 involves all of the deviations of timing associated with the sheet feed sensors 44*a* to 44*c*, registration sensor 46, separation sensor 48, and fixation sensor 50, so that the probability that the arrival and departure timings sensed by the sensor 52 deviate from the reference ranges of FIG. 3 is great. To cope with this problem, the detection timings of the downstream sensors are intentionally shifted, as previously stated.

A specific control procedure in accordance with the present invention will be described.

The timing data shown in FIG. 3 are stored in the non-volatile RAM 62 of FIG. 2. Every time a sheet S moves past each of the sensors, the CPU 54 checks the arrival and departure timings of the sheet S and stores them in the RAM 60 while, at the same time, comparing them with the data stored in the non-volatile RAM 62. If the actual data lie in their predetermined ranges as stored in the non-volatile RAM 62, the CPU 54 decides that the transport is normal; if they do not, then the CPU 54 decides that the paper S has jammed. The CPU 54 averages a plurality of latest of the data written in the RAM 60, then compares the average value with the center value of the data stored in the non-volatile RAM 62, and then feeds back the difference, i.e., increment or decrement to those data which are associated with the following sensors.

As shown in FIG. 3, it is assumed that the center value of the arrival timing at the registration sensor 46 which is stored in the non-volatile RAM 62 is 58. When the average value of the registration sensor arrival timing at a certain time is 59, the increment or +1 relative to the reference value 58 is added to each of the timings which are associated with the registration, separation, fixation and discharge sensors, the sums being written in the non-volatile RAM 62. Then, the subsequent jam detection is performed by using the data as shown in FIG. 4. Needless to mention, such is true with the departure timing as well.

The data corresponding to those of FIGS. 3 and 4 are stored in the non-volatile RAM 62 independently of each other. While the data of FIG. 4 are updated every time a copying cycle is completed, the data of FIG. 3 remain unchanged. The data shown in FIGS. 3 and 4 apply to only one of the sheet cassettes 34*a* to 34*c*, and the other sheet cassettes are different in the distance to the registration sensor 46 from that sheet cassette. It follows that the timings sensed by the various sensors when any of the other sheet cassettes is selected are naturally different from those shown in FIGS. 3 and 4. This, coupled with the fact that the departure timing depends upon the sheet size as well, requires different data which are stored in the non-volatile RAM 62 for each of the sheet cassettes and each of the sheet sizes. Alternatively, considering the fact that the distance downstream of the registration sensor 46 is the same for all of the sheet cassettes, a single set of data may be stored in the RAM 60 and incremented or decremented depending upon the sheet cassette selected. As regards the center values, they may be either calculated from a reference value each time or provided in an exclusive data table.

As stated above, a difference between actual arrival and departure data of a sheet S at any of the sensors and reference data is fed back to the reference data which are assigned to the following sensors, whereby a deviation in timing occurred at the upstream sensor is prevented from extending to the downstream sensors in a cumulative manner. An arrangement may be made such that when the sum of the increments and decrements fed back as described above exceeds a predetermined value, a display or the like, not shown, is energized to alert a person to such an occurrence and, thereby, to urge the person to clean or replace parts of the copier before the copier 10 gets out of order.

Figure 5:
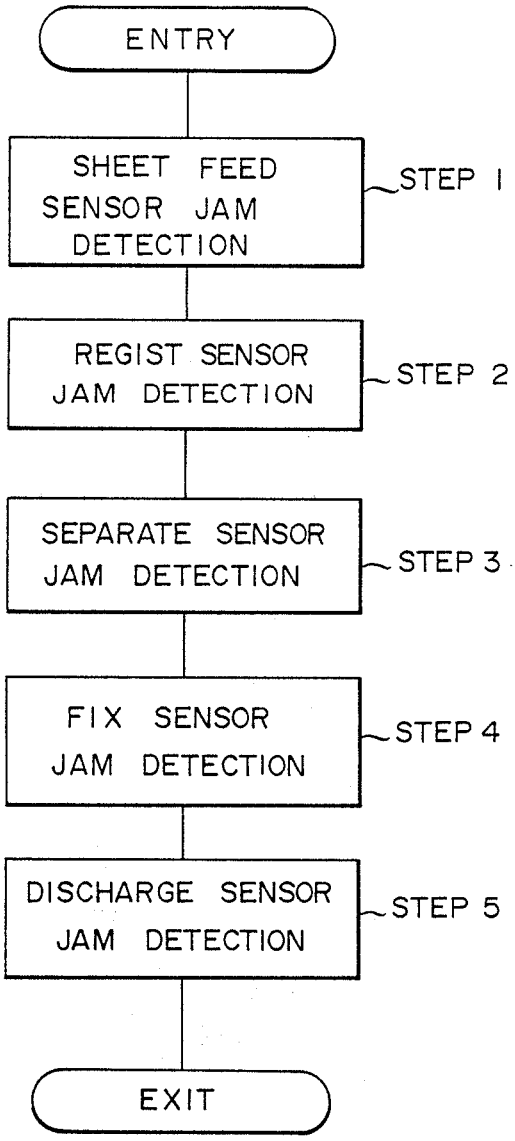
FIG. 5 is a flowchart demonstrating an entire jam detection procedure.
Figures 6, 6A:
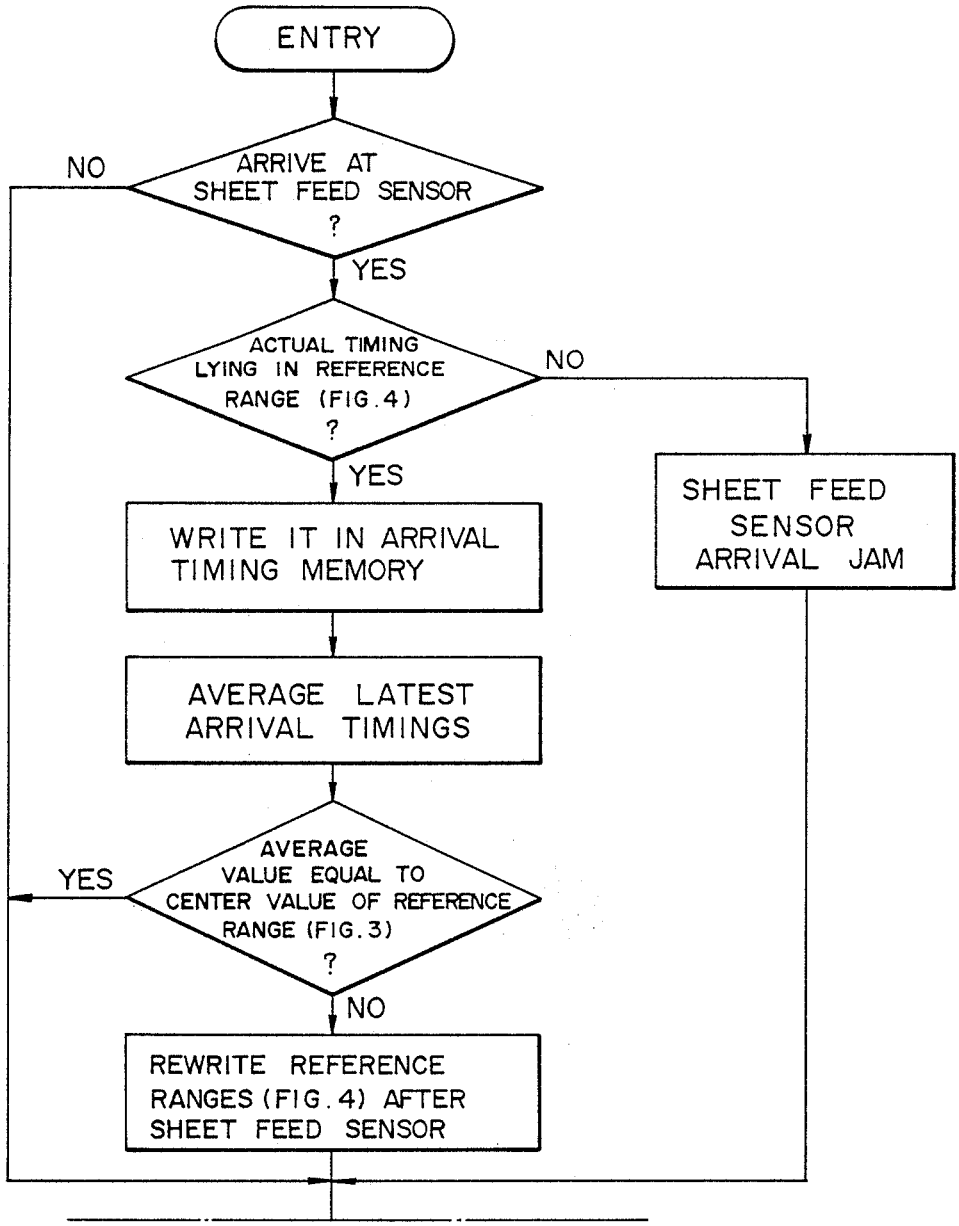
FIG. 6 is a flowchart representative of a control method embodying the present invention.
Figure 6B:
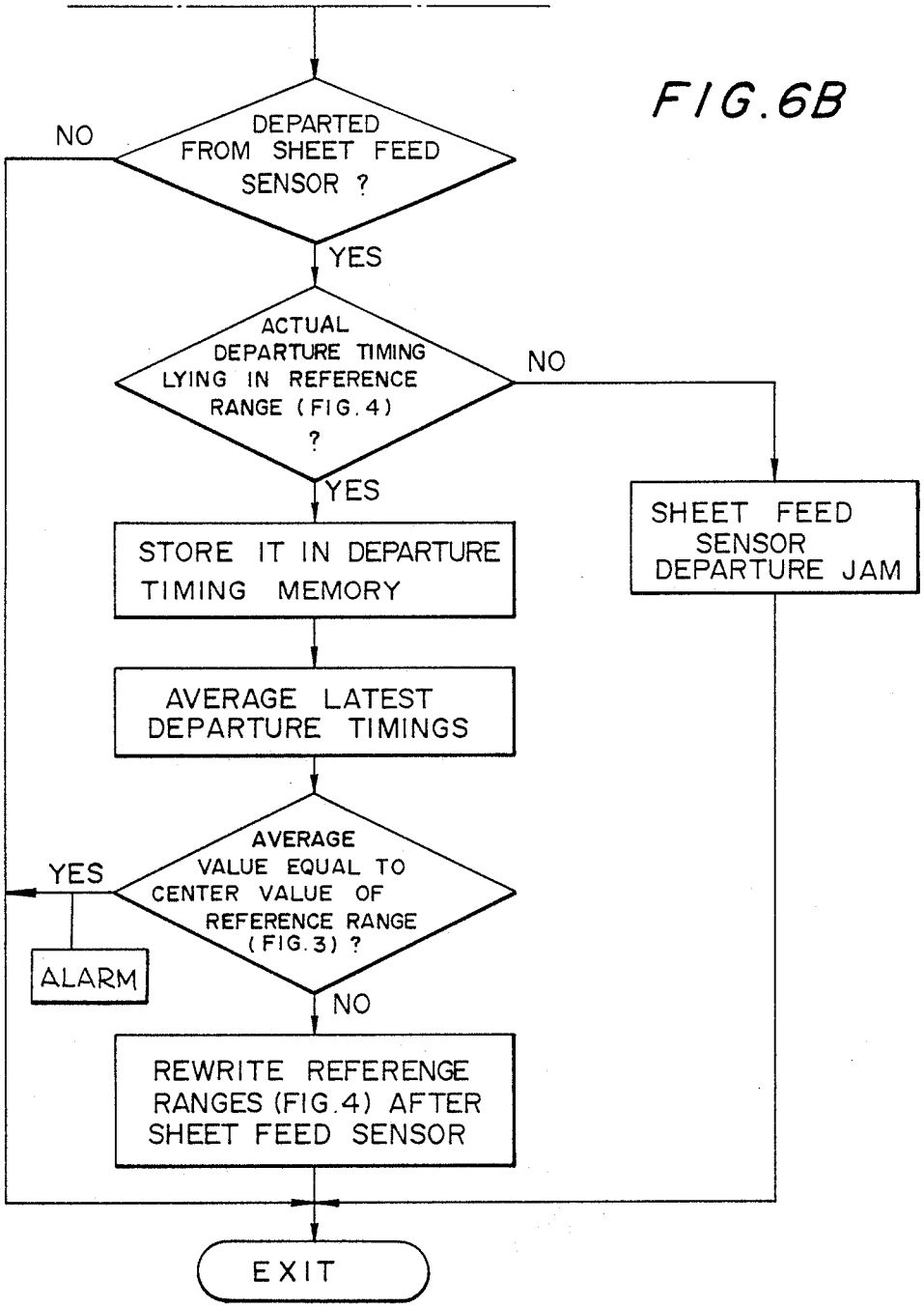

FIG. 5 is a flow chart demonstrating the entire jam detection procedure. More particularly, as shown in FIG. 5, step 1 involves sheet feed sensor jam detection, step 2 involves registration of the sensor jam detection, step 3 involves separate sensor jam detection, step 4 involves fix sensor jam detection and step 5 is directed to discharge sensor jam detection. Further, FIG. 6 is a flowchart showing the sheet transport control in accordance with the present invention. The flowchart of FIG. 6 is representative of jam detection control which is associated with the sheet feed sensors 44*a* to 44*c* (STEP 1 of FIG. 5). FIG. 6 indicates that, upon entry of the sheet, it is determined whether a sheet has arrived at the feed sensor. If such has occurred, it is determined if the actual timing of arrival lies within the reference range as per the parameters shown in FIG. 4. If such lies outside the range, then the sheet feed sensor detects an arrival jam. If the actual timing lies within the reference range, such is noted in the arrival time memory. Next is determined the average latest arrival timings and a determination is made whether the average value is equal to the center value of the reference range. If such does not, then the reference ranges are rewritten after detection by the sheet feed sensor. If departure is detected from the sheet feed sensor, then the step is taken of determining whether the actual departure timing lies in the appropriate reference range of FIG. 4. If such does not, then detection is made of a sheet feed sensor departure jam. If such does lie within the departure timing reference range, an indication of the same is stored in the departure timing memory and compared with the average latest departure timings. If the average value is equal to the center value of the reference range, then an alarm is sounded. If such is not equal to the center value of the reference range, then the reference range rewriting occurs after the sheet feed sensor operation.

In summary, it will be seen that in accordance with the present invention there can be eliminated sheet jams which are ascribable to various factors other than the abnormality of sheet transport drive sources, failure of sensors, and other fatal factors.

Various modifications will become possible for those skilled in the art after receiving the teachings of the present disclosure without departing from the scope thereof.

What is claimed is:

1. A sheet transport control method of an image-forming device which decides whether or not transport of a sheet is normal by comparing with a predetermined reference timing an actual timing of movement of a sheet end past each of a plurality of sensors, said method comprising the steps of:

(a) constantly storing in a memory a plurality of latest timings sensed by one of said sensors;

(b) averaging the lastest timings sensed;

(c) comparing an average timing produced by the step (b) with a reference timing; and (d) if the average timing has an increment or a decrement relative to the reference timing, feeding back the increment or the decrement to reference timings which are assigned, respectively, to each of the remaining sensors located downstream of said one of said sensors.

2. A method as claimed in claim 1, wherein said sensors comprise at least one sheet feed sensor, a registration sensor, a separation sensor, a fixation sensor, and a discharge sensor.

3. A method as claimed in claim 1, wherein the timing of movement past each of said sensors comprises an arrival timing of a sheet leading portion and a departure timing of a sheet ending portion.

4. A method as claimed in claim 1, further comprising the step of (e) producing an alarm when a sum of the increments and decrements fed back exceeds a predetermined value.

* * * * *